US005127544A

United States Patent [19]

Robinson et al.

[11] Patent Number: 5,127,544

[45] Date of Patent: Jul. 7, 1992

[54] METHOD AND APPARATUS FOR HANDLING BUNS AND MEAT PATTIES

[75] Inventors: Hugh Robinson, Wenham; Steven P. Lewalski, Melrose, both of Mass.

[73] Assignee: Design Technology Corporation, Billerica, Mass.

[21] Appl. No.: 509,318

[22] Filed: Apr. 13, 1990

[51] Int. Cl.[5] ..... B65H 3/44

[52] U.S. Cl. ..... 221/93; 221/121; 221/123; 221/124; 221/133; 221/150 R; 221/150 HC

[58] Field of Search ..... 221/93, 112, 116, 119-121, 221/123-124, 129, 133, 150 R, 150 A, 150 HC, 253, 279

[56] References Cited

U.S. PATENT DOCUMENTS

| | | | |
|---|---|---|---|
| 1,807,400 | 5/1931 | Gallagher | 221/121 |
| 1,842,243 | 1/1932 | Boyer | 221/121 X |
| 2,376,561 | 5/1945 | Smith | 221/124 |
| 3,193,138 | 7/1965 | Cox et al. | 221/129 |
| 3,237,804 | 3/1966 | Bardy et al. | 221/112 |
| 3,410,385 | 11/1968 | Freet et al. . | |
| 3,653,541 | 4/1972 | Crum | 221/150 HC |
| 4,129,229 | 12/1978 | Brown | 221/129 |
| 4,378,872 | 4/1983 | Brown | 221/279 |
| 4,483,459 | 11/1984 | Taylor et al. | 221/129 |
| 4,643,313 | 12/1987 | Robson | 221/119 |
| 4,671,425 | 6/1987 | Knoll . | |
| 4,687,119 | 8/1987 | Juillet . | |

FOREIGN PATENT DOCUMENTS

| | | | |
|---|---|---|---|
| 2209331 | 5/1989 | United Kingdom | 221/150 HC |

*Primary Examiner*—David H. Bollinger
*Attorney, Agent, or Firm*—E. T. Barrett

[57] ABSTRACT

An automatic sandwich preparation system including a meat patty and bun storage and delivery system. The patty system includes a number of canisters containing meat patties mounted on a carrousel and tilted inwardly toward the center of the canister. An ejection blade slides the bottom patty from the bottom of a selected canister onto a wire conveyor. Each canister is coded for the size of the meat patties contained in it. The carrousel is mounted in a freezing chamber. The bun system includes parallel shelves holding the bun portions in rows separated by step-driven dividers. The bun portions are delivered from the trays into a bun transport that in turn delivers the bun portions to a toaster.

11 Claims, 8 Drawing Sheets

METHOD AND APPARATUS FOR HANDLING BUNS AND MEAT PATTIES

BACKGROUND OF THE INVENTION

1. Field of the Invention

This invention relates to the rapid and automatic preparation of sandwiches by a system that stores and delivers automatically the components for sandwiches. More particularly it relates to a system for storing and dispensing bread portions and meat patties.

2. Brief Description of the Related Art

In the so-called fast-food industry, the profitability of a food outlet is highly dependent upon the speed with which the food can be delivered and the cost of labor in preparing and packaging the food. There are other factors that can enhance the sales, but these must be done in a manner efficient enough to maintain the necessary profitability. The high volume of such food outlets justifies the assured sanitation and capital costs of automatic handling. At the present time, most preparation is done by hand labor and the use of automatic systems has been limited.

SUMMARY OF THE INVENTION

The present invention is applicable in various respects to different sandwich combinations, but is described as embodied in an automatic hamburger outlet system in which a sales person enters an order on one of several registers and, within a bit more than one minute, a custom cooked-to-order hamburger is delivered automatically to a collection area or to a tray adjacent the register. Both bun and patty size may be selected under computer control in accordance with the input instructions.

The system makes advantageous use of labor by permitting necessary tasks to be performed in advance during slack periods. For example, the morning period prior to the noon rush may be used to fill the storage containers of the automatic food delivery system. The system can then operate for one and one-half hours during the noon rush without further attention other than by an attendant to insure proper operation of the system. The various advantages will be apparent from consideration of the more detailed description of the specific embodiments of the invention.

DESCRIPTION OF THE PREFERRED EMBODIMENTS

Figure 2:
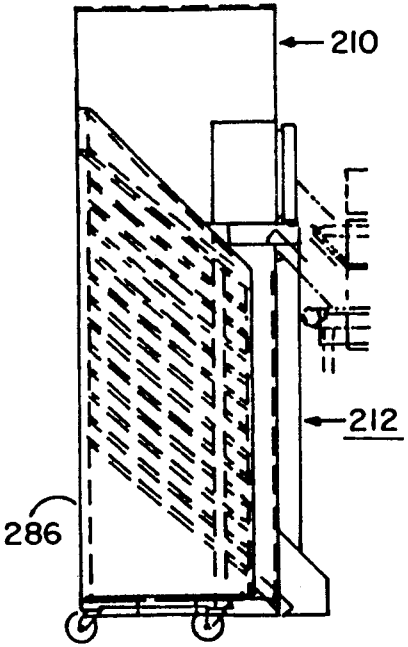
FIG. 2 is a side view of the system illustrated by FIG. 6.
Figure 1:
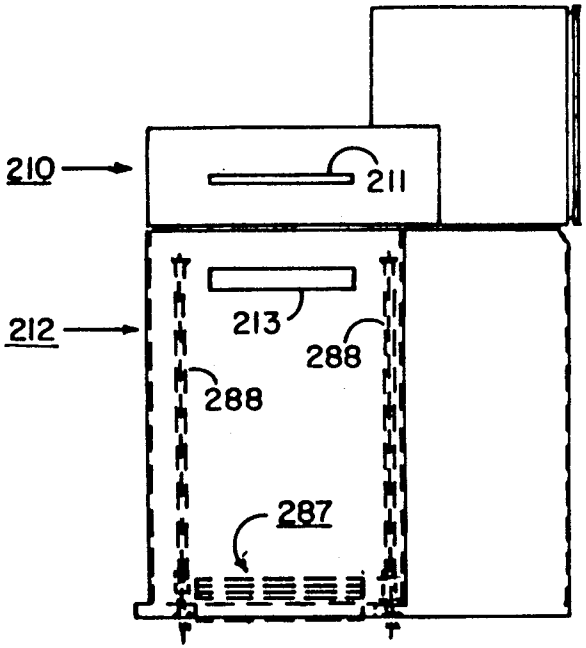
FIG. 1 is a front view of the system for storing and delivering both meat patties and buns.

FIGS. 1 and 2 show a combined bun and patty feeder. A patty handling mechanism, generally indicated at 210, and a bun handling mechanism, generally indicated at 212 respectively deliver stored bun halves and meat patties in response to orders placed by the operator in a computer (not shown). The computer software controls all aspects of the automatic operation of storage and delivery of both meat patties and bread portions. The functions of the computer circuits will be mentioned from time to time in this description, but actual circuits are not shown because both the computer and software are well known for providing the required functions. The meat patties are delivered to a conventional broiler through an output port 211 and the bun portions are delivered to a conventional toasting arrangement through a doorway 213. In this embodiment, the meat patty mechanism 210 handles a total of six canisters, generally indicated at 214 in FIG. 3, each holding from 32–44 meat patties, and by tilting the canisters is able to hold them in considerably less space than would be required if the axes of the canisters were parallel.

Figure 7:
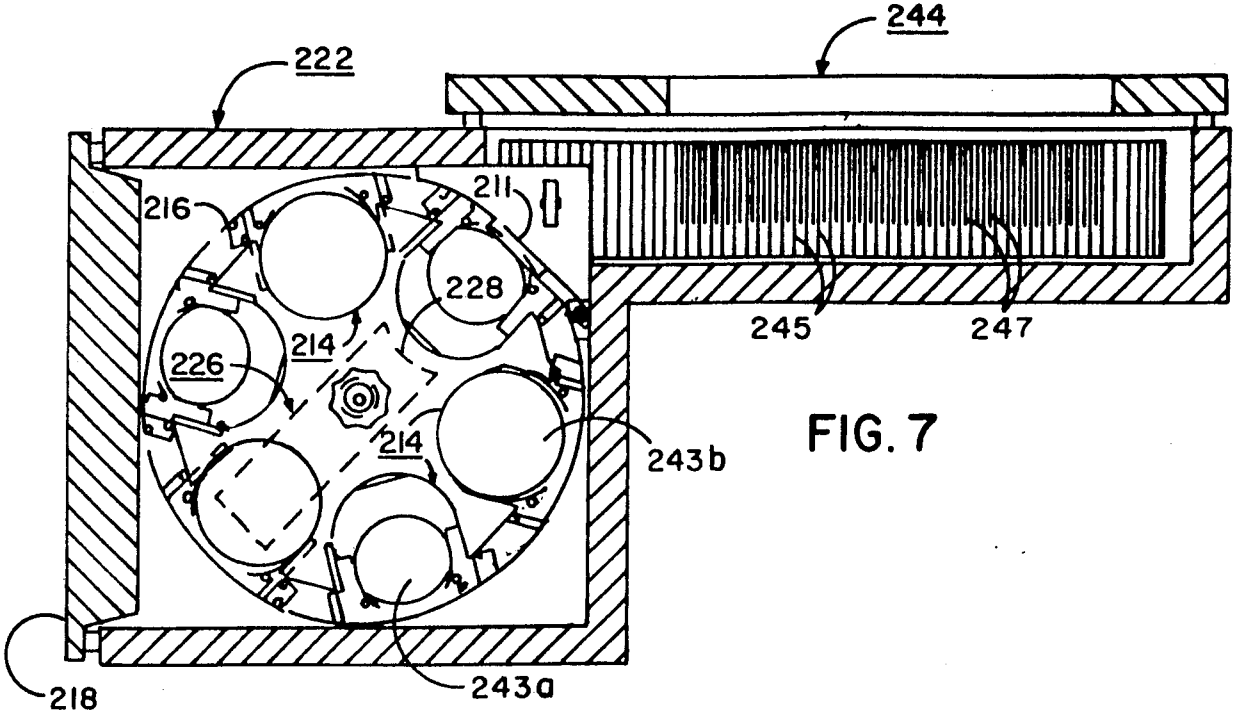
FIG. 7 is a horizontal sectional view through the carrousel and patty delivery system.
Figure 6:
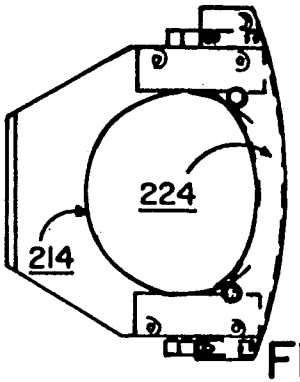
FIG. 6 is a horizontal section through the canister shown in FIG. 5.

The canisters 214, which are each sized for either of two sizes of patties, are replaced with filled canisters as the supply of meat patties is exhausted. Each of the six positions on an indexing carousel 216 (FIGS. 4 and 7) is capable of receiving one of the canisters 214 (see also FIGS. 5 and 6) for storing either large or small patties.

In operation, the carrousel 216, which carries the canisters 214, and which at all times when not actually delivering a meat patty is free to rotate, is manually positioned to place the proper canister opening adjacent a door 218 (FIG. 7) that forms one wall of an insulated chamber, generally indicated at 222. The door is opened and an empty canister is removed and replaced on the carousel 216 by a filled canister. If the canister being loaded carries the smaller size meat patties, the canister 216 carries a projection that actuates a switch (not shown) on the carousel that indicates to the computer control that the canister contains the smaller size patties. If this coding projection is missing, the computer assumes it is a canister with larger size patties. Other coding mechanisms, well known in the art, may be used to distinguish the canisters.

After the loading is complete, the door 218 is closed and the patties are maintained at a cold or freezing temperature. In this particular embodiment, patties and buns are made available only in multiples of two. When an order is placed, the carousel 216 rotates to bring either a large or small canister to the output port 211. The bottom patty in the canister is pushed out of the canister by an ejection slide, generally indicated at 226 in FIGS. 7 and 8, which has an arcuate leading edge 228 that makes contact with the meat patties. The edge 228 is tapered to form a sharp upper edge that separates the bottom meat patty from the one above in the canister 214.

Figure 3:
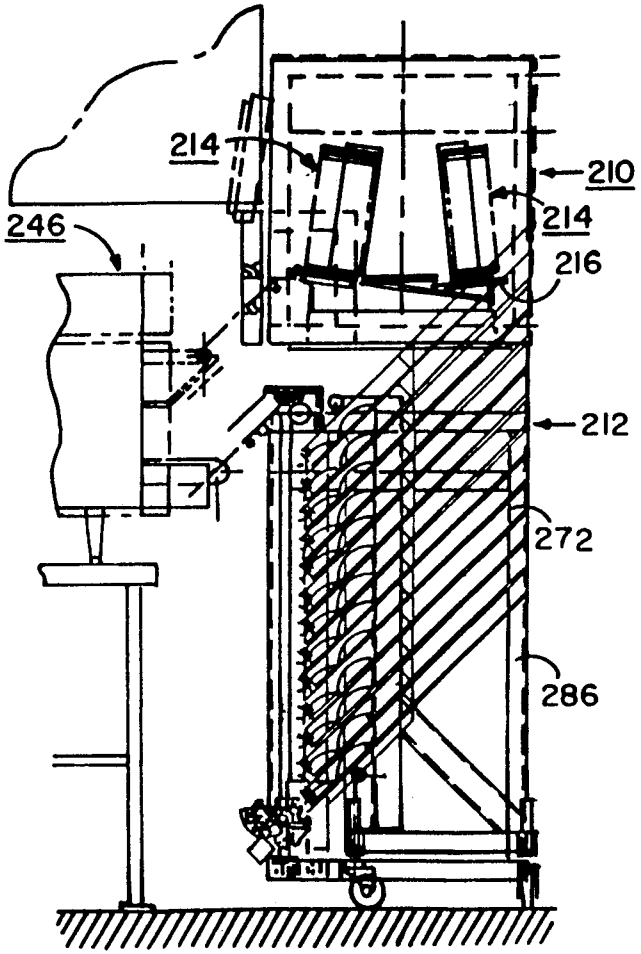
FIG. 3 is a vertical section through the system illustrated by FIGS. 6 and 7.
Figure 4:
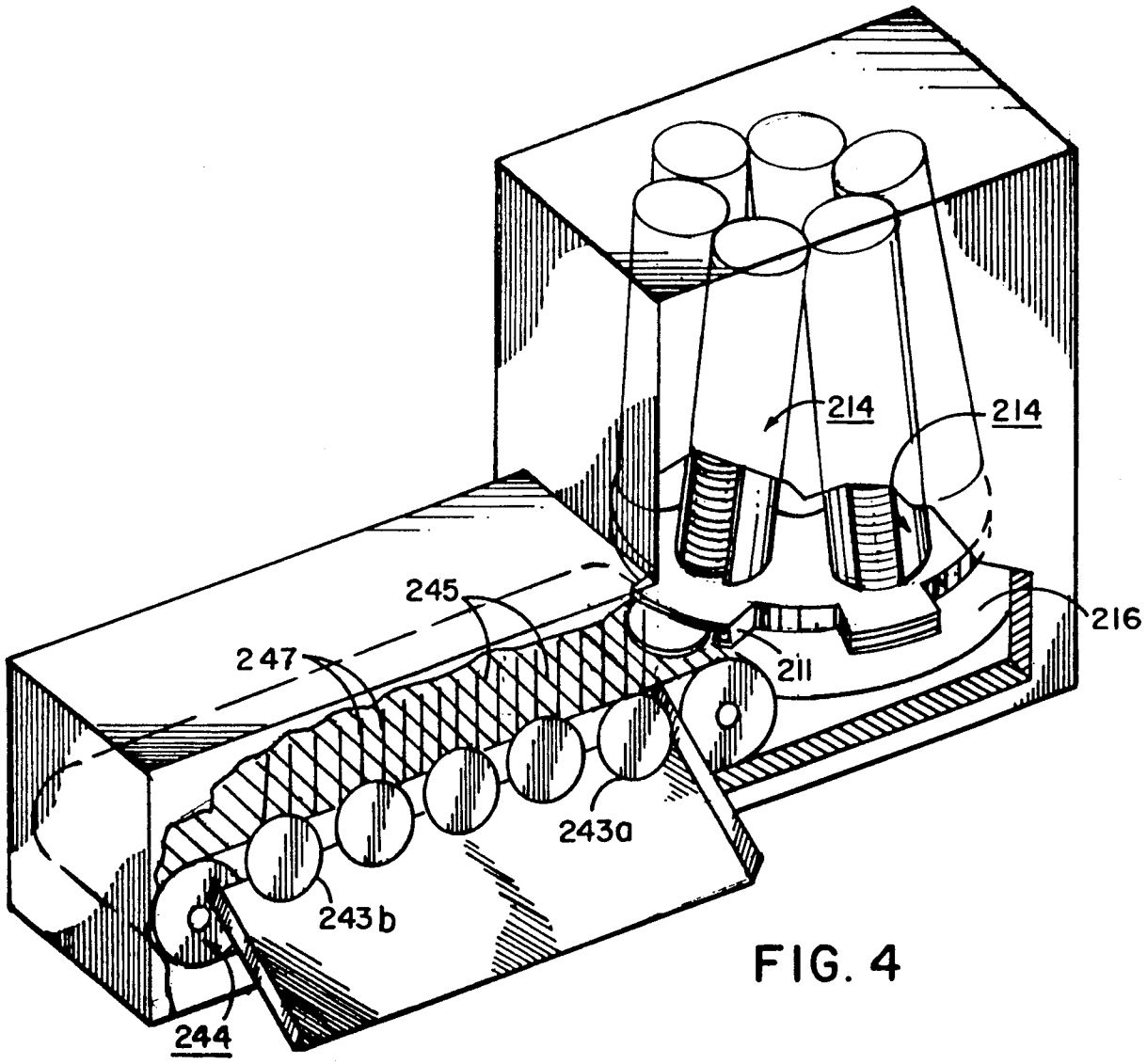
FIG. 4 is a diagrammatic perspective view showing parts of the carrousel and delivery system.
Figure 5:
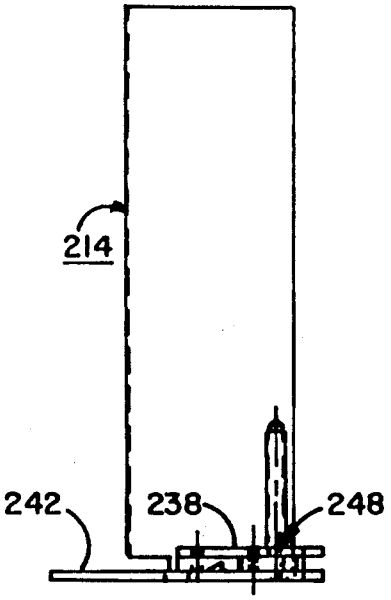
FIG. 5 is a vertical section through one of the canisters for storing meat patties.

The ejection slide 226 reciprocates in a plane that is perpendicular to the longitudinal axis of the canister at the point where a patty is being delivered from the particular canister. Each of the canisters is tilted toward the center of the carrousel (FIGS. 3 and 4). This arrangement permits the ejection slide 226 to move beneath the canister that is opposite the one at the ejection port. If the canisters were not tilted, the ejection slide would operate in a horizontal plane and the carrousel would need to be large enough to permit the unrestricted movement of the ejection slide 226.

Figure 9:
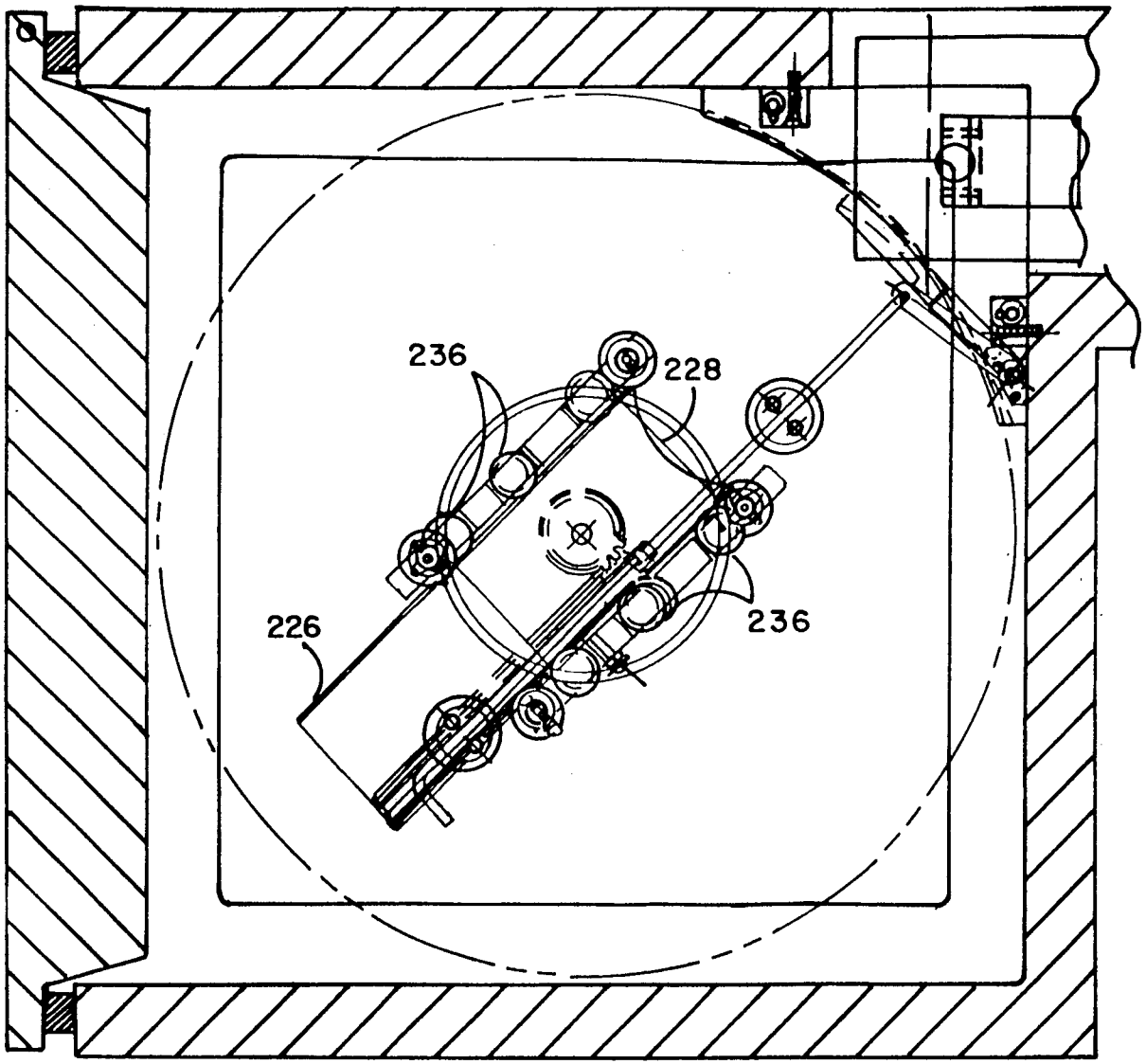
FIG. 9 is a horizontal section through the carrousel showing the pulleys for guiding the patty ejection slide along an angular path.
Figure 10:
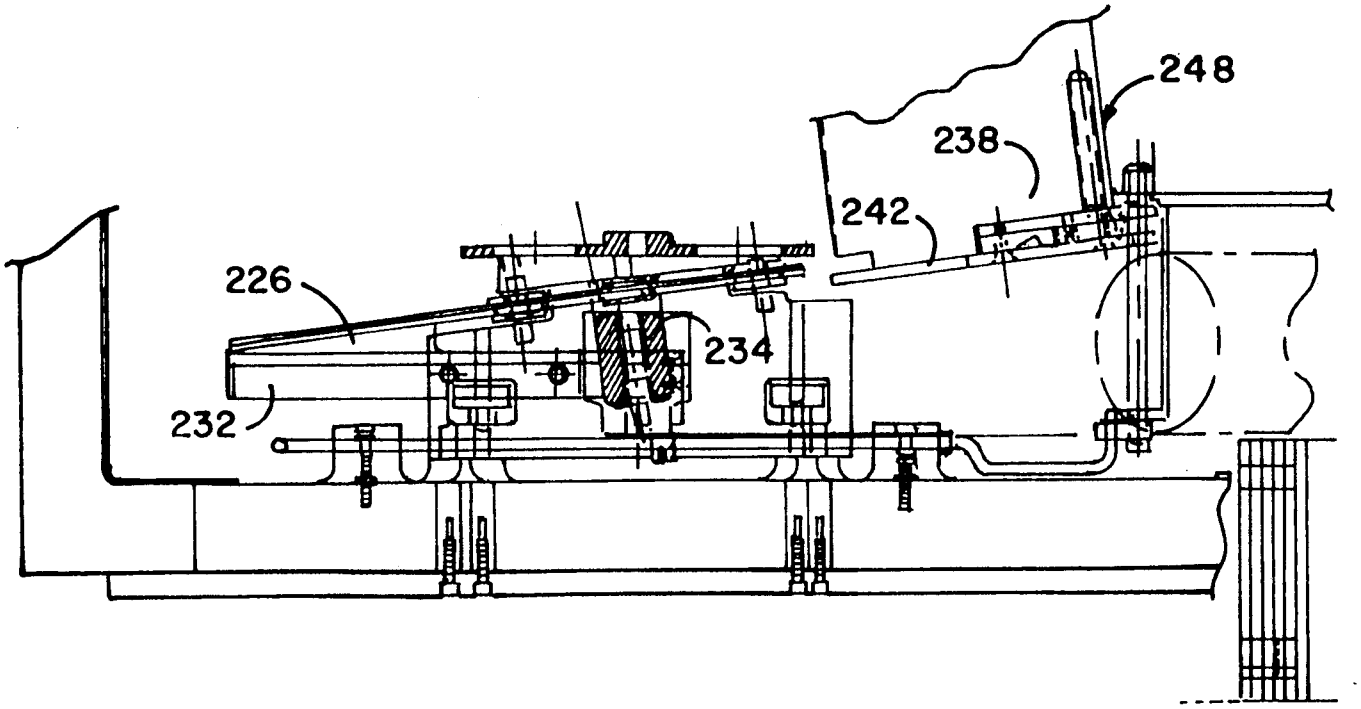
FIG. 10 is a partial vertical section illustrating the drive mechanism for the plate that ejects the meat patties.

The ejection slide 226 is driven by a rack 232 and pinion 234 (FIGS. 9 and 10). The rack 232 is secured to the ejection slide 226 and produces the reciprocating motion. As the slide moves outwardly of the carousel, the rack 232 moves upwardly (FIG. 10) on the associated pinion 234. The ejection slide is supported by a series of grooved pulleys 236 (FIG. 9) that engage the edges of the ejection slide 226. A separation blade 238 (FIG. 10) is positioned within the canister above its floor 242 by a distance equal to the thickness of one meat patty. The ejection slicer forces the meat patty being ejected beneath this separation plate and helps separate it from the stack above. When a meat patty is ejected, it drops onto a stepping conveyor, generally indicated at 244 in FIGS. 4 and 7. As each meat patty, indicated at 243*a* and 243*b*, is received, the conveyor 244 indexes to move the patty outwardly away from the carrousel. Because of the sensing mechanism that includes the coding of the canisters, the number of index steps adjusts automatically depending upon whether it is a small patty 243*a* or a large patty 243*b* that is being delivered.

The base of the conveyor is formed of a strip of spaced wires 245 extending perpendicularly to the direction of conveyor movement. When the conveyor has been filled with meat patties, or as many as the current order calls for, a second set of spaced lift-off wires 247, extending parallel with and below the wires that form the conveyor and each positioned in a space between adjacent conveyor wires 245, are pivoted upwardly to slide the patties off and into a conventional broiler, diagrammatically indicated at 246 in FIG. 3. Except for the specific features enumerated here the conveyor 244 is conventional in all respects.

If the ejection slide 226 moves all the way forward and no meat patty appears at the exit port, the condition is sensed by a sensor, diagrammatically illustrated at 248 in FIG. 10. After a second sensor test that also indicates an empty canister, the carrousel 216 is automatically moved to position another canister of the same size at the output port. At the same time, a signal light (not shown) indicates to the operator that the designated canister is empty. The sensor 248 may be any conventional proximity sensor.

Figure 8:
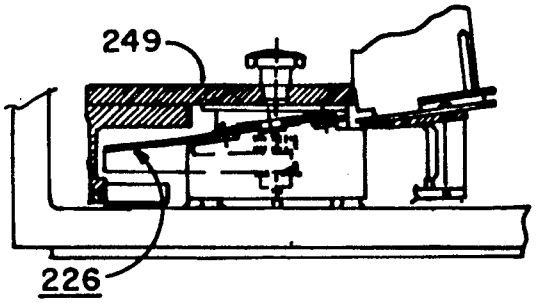
FIG. 8 is a partial vertical section through the lower part of the carrousel.
Figure 11:
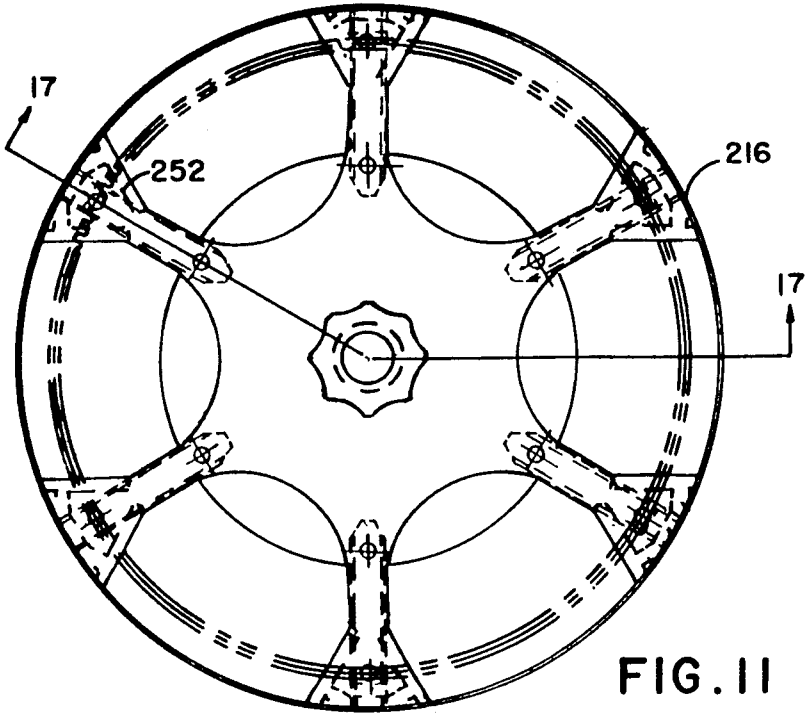
FIG. 11 is a horizontal section through the carrousel showing the canisters and the drive for rotation of the carrousel.
Figure 12:
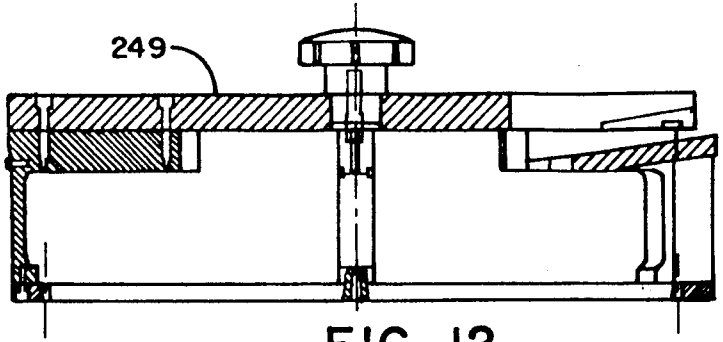
FIG. 12 is a sectional view along line 16—16 of FIG. 10.

The base 249 of the carrousel 216 is rotatably supported as shown in FIGS. 8 and 12. The carrousel is driven by a conventional motor drive (not shown) through a gear that engages an internal ring gear 252 (FIG. 11) on the undersurface of the carrousel 216.

Figure 13:
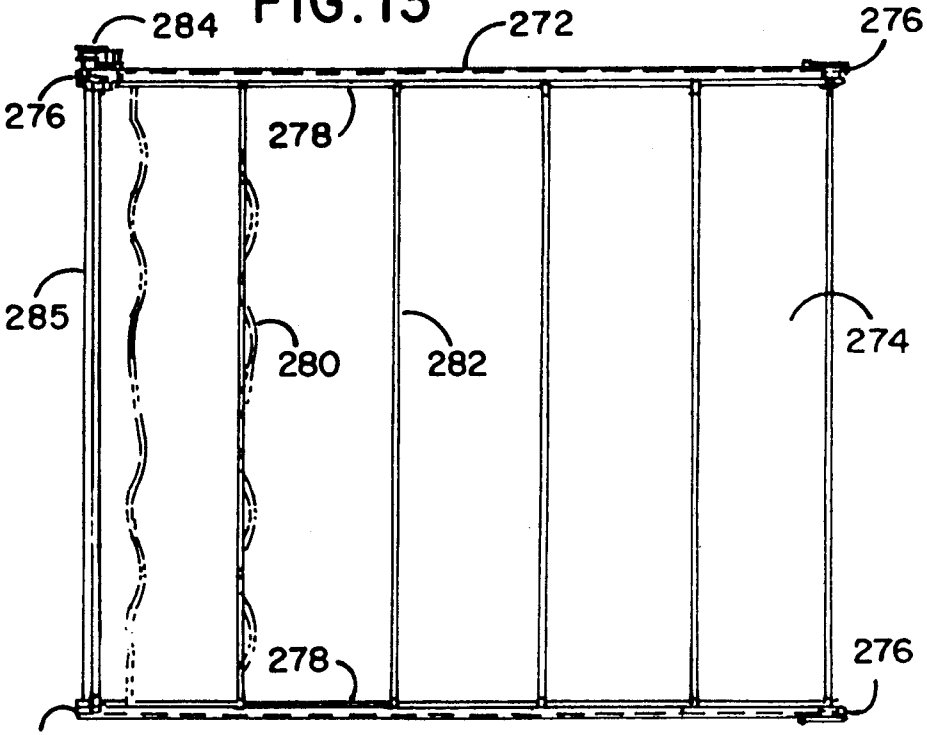
FIG. 13 is a plan view of one of the bun-holding trays.
Figure 14:
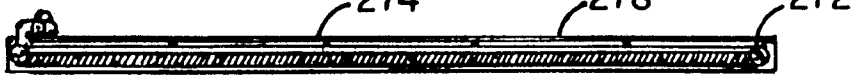
FIG. 14 is a longitudinal sectional view of the bun-holding tray of FIG. 13.
Figure 17:
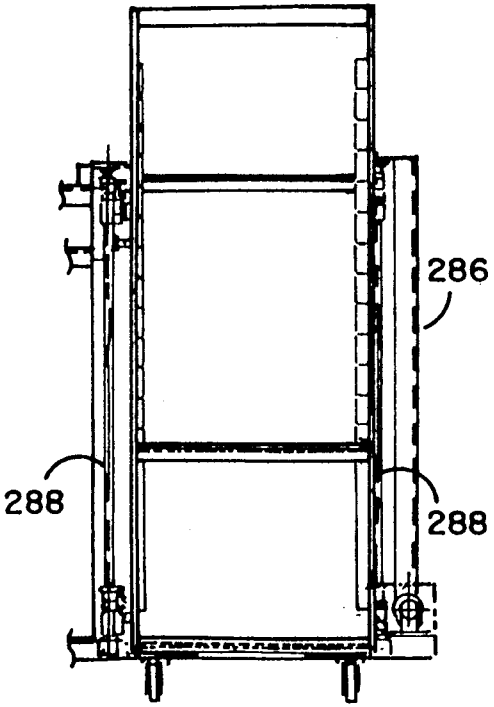
FIG. 17 shows the rack holding the bun tray assembly for vertical movement.

The bun storage and delivery chamber 212 is positioned below and to one side of the patty storage chamber 210 as shown in FIGS. 1–3. The bun portions are supported in spaced rows on thirteen sloping trays 272. Even though the trays 272 are sloping, because of the nature of the bun portions, gravity feed is not a satisfactory answer for feeding the buns from the trays. Each tray 272 includes a solid base panel 274 (FIGS. 13 and 14) that carries four pulleys 276 supporting the conveyor mechanism which comprises two flexible cables 278 on opposite sides of the panel 274. A series of dividers 282 extend across the tray between the cables. Each of these dividers travels downwardly along the upper surface of the panel 274 and returns on the under side of the panel. These dividers, which may form an undulating pattern to position the bun portions, as indicated at 280 in FIG. 13, control the movement of the buns. Each tray holds four bun portions across each horizontal row defined by the dividers. Movement of the tray conveyor is provided through a drive pulley 284 that is connected by a rod 285 to two of the conveyor pulleys 276.

Figure 18:
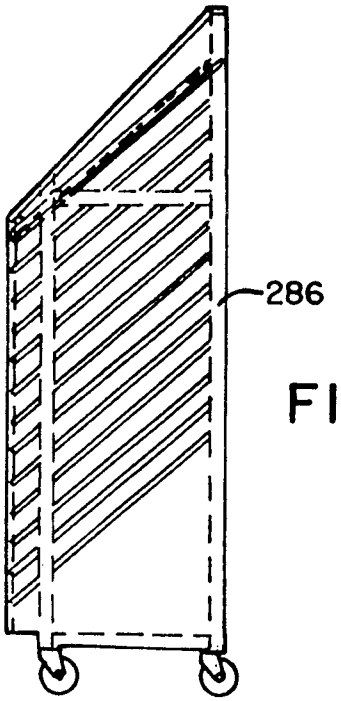
FIGS. 18A–18C are a composite view showing the rack and trays and enlarged portions of the tray drive mechanism.
Figure 18B:
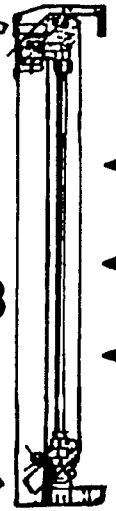
Figure 18A:
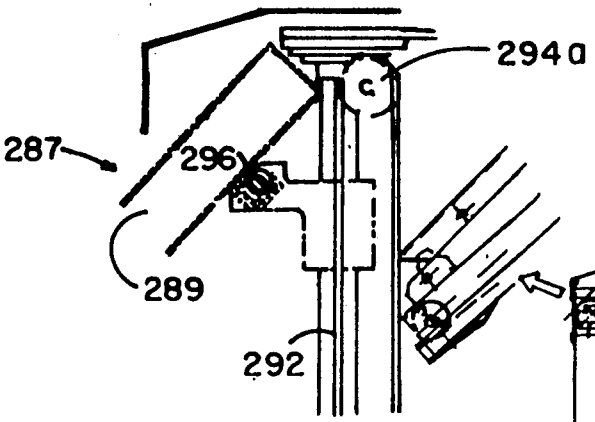
Figure 18C:
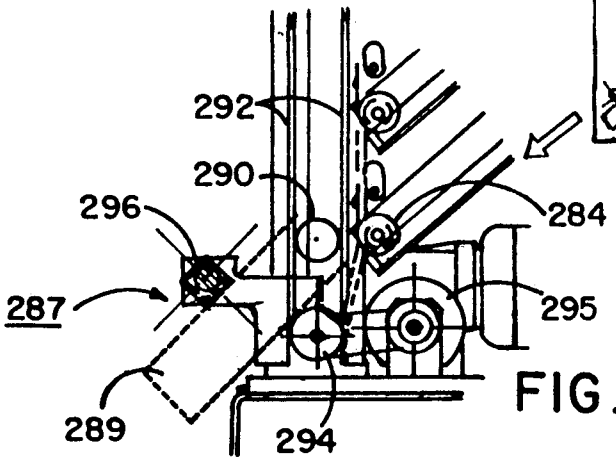

The trays 272 are mounted in a rack 286 (FIG. 3). The buns are delivered from a selected tray into a bun transport, generally indicated at 287 in FIGS. 1 and 18. The bun transport 287 is driven vertically along the lower edges of the trays 272 by a pair of lead screws 288 (FIG. 1) by means of a conventional motor drive (not shown). The bun transport 287 includes a bun rack 289 that receives the bun portions from the trays 272.

Figure 15:
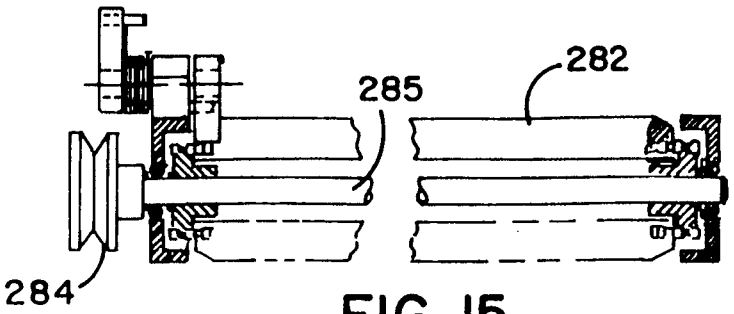
FIG. 15 is a vertical section across the tray of FIG. 13 through the drive section of the tray.
Figure 16:
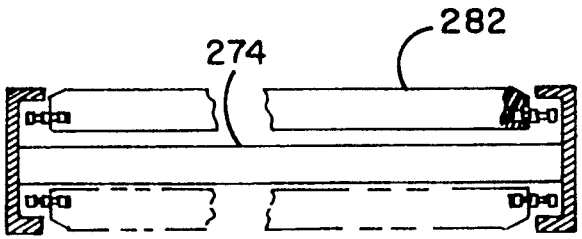
FIG. 16 is a section across the bun tray of FIG. 6 through one of the dividers.

Under the control of the computer, the bun transport is positioned to receive bun portions from an unemptied tray. In order to drive the dividers 282 of the selected tray, a pulley wheel 290 is mounted between opposite portions of an o-ring loop 292. This loop is supported by two pulleys 294 and 294*a* (FIG. 18) and is driven in continuous rotation by a drive motor 295. The pulley 290, positioned within the o-ring loop 292, is carried with the bun transport 287 and is arranged for horizontal movement by a mechanism (not shown). When the bun rack 289 has been positioned at the appropriate bun tray, the pulley 290 is moved toward the right (as viewed in FIG. 18) to force the o-ring loop 292 into engagement with the drive pulley 284 (FIG. 15) that causes step rotation of the dividers 282 by enough distance to deliver one row of bun portions into the bun rack 289. The pulley 290 (FIG. 18) is then retracted to its neutral position and the bun transport 287 is moved by the lead screws 288 to its topmost position. The bun rack 289 is then rotated (by a conventional mechanism not shown) about a supporting axis 296 to the position shown in the top section of FIG. 18 causing the bun portions to slide from the bun rack out through the doorway 213. The rows of bun portions may consist, for example, of two top and two bottom portions of either large or small buns or a combination of the two. Conventional coding devices (not shown) indicate to the computer and to the operator which trays have been emptied of bun portions. The computer selects an appropriate tray that has not been emptied and which contains the bun portions called for by the computer program.

We claim:

1. In an automatic sandwich preparation system, a bun and patty feeder comprising a computer, a patty storage and delivery mechanism including a carrousel having an output port, means for rotatably indexing said carrousel, a plurality of manually-replaceable canisters for containing meat patties carried by said carrousel, means for delivering meat patties from said carrousel comprising an indexing conveyor positioned to receive meat patties from said output port, an ejection blade slideably positioned on said carrousel and extending into a canister positioned adjacent said output port, and means for moving said ejection blade radially outwardly and ejecting a meat patty from said canister to said conveyor, and a bun storage and delivery system comprising a plurality of bun-holding trays each including bun ejection means comprising a series of spaced dividers slideably mounted on the surface of one of said trays for simultaneously ejecting a plurality of bun portions from said tray, a bun transport having a bun rack, means under the control of said computer for positioning said bun transport adjacent a selected one of said trays, means for indexing said dividers to cause bun portions held by said tray to be delivered to said bun transport, and means for ejecting said bun portions from said bun transport.

2. The combination as claimed in claim 1 wherein said carrousel includes canisters of two different diameters.

3. The combination as claimed in claim 2 including sensor means for denoting the size of said canisters.

4. The combination as claimed in claim 1 wherein said canisters are tilted at an angle significantly greater than zero degrees from the axis of rotation of said carrousel.

5. The combination as claimed in claim 1 wherein said conveyor includes a first set of wires.

6. The combination as claimed in claim 5 including a second set of spaced wires positioned between said first set of wires, and means for angularly displacing said second set of wires to discharge said meat patties.

7. The combination as claimed in claim 1 wherein said trays are spaced vertically and including means for moving said bun transport vertically to position it adjacent a selected tray.

8. The combination as claimed in claim 1 wherein said means for indexing said dividers includes a drive means carried by said bun transport selectively applicable to one of said trays for applying a positive driving force to the dividers on said tray.

9. In an automatic sandwich preparation system, a meat patty storage and delivery system comprising a carousel having an output station, a plurality of manually-replaceable canisters of two different diameters and of generally circular cross section for containing a stack of meat patties carried by said carousel, sensor means for denoting the size of said canisters, means for rotatably indexing said carrousel to position a preselected one of said canisters adjacent said output station, and means for delivering the bottom meat patty from said carrousel comprising an indexing conveyor positioned to receive meat patties from said output station, an ejection blade slideably positioned on said carrousel and extending into a canister positioned adjacent said output port; and means for moving said ejection blade radially outwardly and ejecting the bottom meat patty from said canister onto said conveyor.

10. In an automatic sandwich preparation system, a meat patty storage and delivery system comprising a carousel having an output station, a plurality of manually-replaceable canisters of generally circular cross section for containing a stack of meat patties carried by said carrousel, means for rotatably indexing said carrousel to position a preselected one of said canisters adjacent said output station, each of said canisters being tilted at an angle significantly greater than zero relative to the axis of rotation of said carrousel, and means for delivering the bottom meat patty from said carrousel comprising an indexing conveyor positioned to receive meat patties from said output station, an ejection blade slideably positioned on said carrousel and extending into a canister positioned adjacent said output port; and means for moving said ejection blade radially outwardly and ejecting the bottom meat patty from said canister onto said conveyor.

11. In an automatic sandwich preparation system, a meat patty storage and delivery system comprising a carousel having an output station, a plurality of manually-replaceable canisters of generally circular cross section for containing a stack of meat patties carried by said carrousel, means for rotatably indexing said carrousel to position a preselected one of said canisters adjacent said output station, and means for delivering the bottom meat patty from said carrousel comprising an indexing conveyor having a first set of spaced parallel wires positioned to receive meat patties from said output station, an ejection blade slideably positioned on said carrousel and extending into a canister positioned adjacent said output port; and means for moving said ejection blade radially outwardly and ejecting the bottom meat patty from said canister onto said conveyor, said conveyor including a second set of spaced wires positioned between said first set of wires, and means for angularly displacing said second set of wires to discharge said meat patties.

* * * * *